US007079031B2

(12) United States Patent
Ott

(10) Patent No.: US 7,079,031 B2
(45) Date of Patent: Jul. 18, 2006

(54) SENSOR ELEMENT FOR A MONITORING DEVICE

(76) Inventor: Reinhold Ott, 6 Willow Street, Unit 2303, Waterloo, Ontario (CA) N2J 4S3

( * ) Notice: Subject to any disclaimer, the term of this patent is extended or adjusted under 35 U.S.C. 154(b) by 106 days.

(21) Appl. No.: 10/382,889

(22) Filed: Mar. 7, 2003

(65) Prior Publication Data

US 2003/0210144 A1 Nov. 13, 2003

(30) Foreign Application Priority Data

Mar. 8, 2002 (DE) ..... 102 10 299

(51) Int. Cl.
*G08B 13/06* (2006.01)

(52) U.S. Cl. ..... 340/568.2; 340/568.1; 340/568.4; 340/571; 340/572.1; 340/572.5; 340/572.8

(58) Field of Classification Search ..... 340/568.2, 340/568.4, 568.1, 571, 572.1, 650, 652, 686.1, 340/687, 572.5, 572.8
See application file for complete search history.

(56) References Cited

U.S. PATENT DOCUMENTS 3,932,857 A * 1/1976 Way et al. ..... 340/568.2
4,455,464 A * 6/1984 Leyden ..... 200/61.93
5,146,205 A * 9/1992 Keifer et al. ..... 340/568.2
5,543,782 A * 8/1996 Rothbaum et al. ..... 340/568.2
5,604,484 A * 2/1997 Rogers ..... 340/568.8
5,886,633 A * 3/1999 Adams ..... 712/227
5,936,525 A * 8/1999 Leyden et al. ..... 340/568.2
6,104,311 A * 8/2000 Lastinger ..... 340/10.51
6,236,435 B1 * 5/2001 Gertz ..... 348/373
6,255,958 B1 * 7/2001 Haimovich et al. ..... 340/686.6
6,353,389 B1 * 3/2002 Matsuo ..... 340/571
6,396,401 B1 * 5/2002 Matsuo ..... 340/568.4
6,752,837 B1 * 6/2004 Karp ..... 340/572.1

FOREIGN PATENT DOCUMENTS

EP 0260330 3/1988
GB 2287339 9/1995

* cited by examiner

*Primary Examiner*—Davetta W. Goins
(74) *Attorney, Agent, or Firm*—Harness, Dickey & Pierce, P.L.C.

(57) ABSTRACT

A sensor element may be provided for a monitoring device designed to protect displayed merchandise against theft. The sensor element may be flexible and include a sensor layer with a measuring circuit loop integrated therein. During attempted theft, a contact element that may be arranged on an adhesive surface creates an open in the measuring circuit loop, thereby triggering an alarm.

10 Claims, 4 Drawing Sheets

SENSOR ELEMENT FOR A MONITORING DEVICE

The present application hereby claims priority under 35 U.S.C. §119 on German patent application number DE 102 10 299.6 filed Mar. 8, 2002, the entire contents of which are hereby incorporated herein by reference.

FIELD OF THE INVENTION

The present invention generally relates to a sensor element for a monitoring device for the purpose of protecting a displayed product against theft with a sensor layer that is equipped with a measuring circuit loop.

Furthermore, the present invention generally relates to a monitoring device for protecting a displayed product against theft with a processing circuit and a cable for connecting a sensor element with the processing circuit. The sensor element may include a sensor layer that is equipped with a measuring circuit loop.

BACKGROUND OF THE INVENTION

Well-known monitoring devices are utilized preferably in department store showrooms and serve to prevent an unnoticed removal of goods in the case of showroom models, in particular removal of upscale electronic devices, which are generally freely accessible to customers for testing purposes.

Purely mechanical theft protection systems provide fastening of the product with a thin steal wire or a plastic line, which is firmly connected with a fastening piece that is glued to the product. In addition, the steal wire or plastic line is attached to an object that cannot be transported, such as, for example, the display shelf or a larger device.

Apart from this, electronic monitoring devices are well known. Their main advantage lies in the possibility of detecting sabotage or earlier removal attempts and thus activating an early corresponding alarm.

With traditional electronic monitoring devices, this is achieved by mounting a sensor element to the product. In particular, the element is connected with a central processing unit by way of a cable. The sensor element delivers a measured variable that already changes with the attempt to detach the sensor element or the cable from the product. The processing unit processes the measured variable supplied by the sensor element and if necessary activates the alarm.

Popular sensor elements may include microcircuits or optical transmission systems or wire strains gages. Based on their size, however, sensor elements with microcircuits are in most cases unsuitable for protecting modern cell phones or electronic schedule books. Furthermore, correct mounting of the sensor element to the product housing is very difficult due to the complex housing shape—in particular, for very modern devices comprising many curvatures.

With wire strain gages and optical detector equipment, very small sensor elements are possible in principle; however, these feature an equally high price and are reusable only to a limited degree after forceful removal from the product.

Another version of electronic monitoring systems is known from EP 0 663 656 B1. The patent document discusses an electronic conductor loop on a sensor element equipped with predetermined breaking points. The conductor loop is destroyed through removal of the sensor element from the product during a theft attempt so that the sensor element is not reusable.

SUMMARY OF THE INVENTION

An embodiment of the present invention provides a sensor element for a monitoring device that is at least partially reusable.

Yet another embodiment of the present invention provides a sensor element that includes a measuring circuit loop featuring a break, and a sensor layer can be fastened to a product by way of an adhesive layer in such a way that a contact element located on the surface of the adhesive layer may short-circuit the break.

Still another embodiment of the present invention includes a measuring circuit loop contains a break, and a sensor layer is connected with an adhesive layer, with which the sensor layer can be attached to a product in such a way that a contact element located on the surface of the adhesive layer short-circuits the break. The adhesive layer and the sensor element form a unit, enabling particularly simple packaging or installation.

The measuring circuit loop of the sensor element may, for example, be connected through a cable with a processing circuit that constantly monitors the condition of the measuring circuit loop. In addition a voltage can be fed on the measuring circuit loop so that a test current flows through the measuring circuit loop, which is shorted in the idle state. With this arrangement the cable to the processing circuit may form a part of the measuring circuit loop.

As soon as the measuring circuit loop is interrupted, the test current may no longer flow, enabling the processing circuit to detect an alarm condition and if necessary activate optical and/or acoustical alarm signals as well as forward the alarm to a central station.

An interruption of the measuring circuit loop may occur by severing the cable or separating the cable from the sensor element. In this case the test current may no longer flow through the measuring circuit loop, and an alarm condition is detected.

An additional possibility for interrupting the measuring circuit loop occurs by moving the sensor layer of the sensor element with the measuring circuit loop integrated therein relative to the adhesive layer or to the contact element arranged on the adhesive layer in such a way that two end contacts of the measuring circuit loop that define the interruption of the measuring circuit loop are no longer short-circuited through the contact element across from the end contacts.

In particular, an embodiment of the present invention provides that the measuring circuit loop short-circuited by the contact element may be interrupted when applying a force that acts vertically to the surface of the adhesive layer onto the sensor layer of the sensor element, thus activating an alarm state.

The above-described application of force may occur during a theft attempt during which it is attempted to pull off the sensor element that is attached to the product by grabbing the sensor surface facing away from the product.

At least one force component acting vertically to the surface of the adhesive layer also occurs when an attempt is made to pull the sensor element off the product by grabbing a cable that is connected to the sensor surface.

In both of the above cases, the sensor layer may be lifted off the adhesive layer upwardly at least in the end contact area, which suspends the electrical connection between the end contacts and the contact element and interrupts the measuring circuit loop.

An additional increase in reliability regarding the detection of a theft attempt may be achieved with a very beneficial design of the sensor element of an embodiment of the present invention, in that the measuring circuit loop short-circuited by the contact element can be interrupted when a force, which acts parallel to the surface of the adhesive layer, is applied to the adhesive layer, thus triggering an alarm condition.

This also helps to ensure reliable detection of a lateral removal of the adhesive layer between the product and the sensor layer. In general, any shifting of the contact element and the end contacts relative to each other, during which the change in ohmic resistance of the measuring circuit loop caused by the shift exceeds a threshold specified by the sensitivity level of the processing circuit, is sufficient to activate an alarm.

A design of the adhesive layer as double-sided adhesive strip according to an embodiment of the present invention may be beneficial to further increase the sensitivity level and the flexibility of the sensor element. This results in a very high reliability of theft detection with removal only from the side. In general, the adhesive layer with this version is particularly simple and can be removed again from the product without leaving any adhesive residue.

During operation of a sensor element for product protection, it is possible, through the extremely high elasticity of the adhesive strip, that the contact element—in reaction even to a force acting parallel to the surface of the adhesive layer—is shifted sufficiently relative to the end contacts of the sensor layer so that the measuring circuit loop is interrupted at least short-term.

The adhesive layer in general allows a very thin, and with it, a virtually inconspicuous design, which is important particularly in the case of very small products so as not to influence the customer's view of the optical impression of the product. A very thin cable for connection with the processing circuit can be designed so that removal of the secured displayed product is possible.

A particularly good adaptation of the sensor element to the product to be secured may be achieved in that the sensor element is flexible and/or elastic. Therefore, the sensor element may be placed on parts of surfaces of devices with curvatures. In particular, the sensor element is very adaptable if the measuring circuit loop that is integrated in the sensor layer is also flexible, for example, as film conductors.

According to an embodiment of the present invention, a signal circuit may be provided for displaying the alarm condition. It may be beneficial to utilize a light-emitting diode in the form of a surface mounted device (SMD) for optical signaling. It is also possible that the signal circuit signals an arming of a circuit of the sensor element or other operation conditions.

It may also be beneficial that the technical circuitry complexity is reduced when the signal circuit and the measuring circuit loop use, for example, a mutual ground wire.

According to an embodiment of the present invention, the sensor element may include a connecting element and/or a cable for the electrical connection of the measuring circuit loop and/or the signal circuit with a processing circuit.

In general, the connecting element can be connected to the processing circuit and detached, allowing for the easy exchange of sensor elements and/or cables.

It may be beneficial to provide reusable sensor elements that can be detached from the processing circuit and again re-attached thereto with little effort.

A secure connection of the connecting element with the processing circuit and/or the cable is likewise conceivable. In this case, a unit the includes a cable and a sensor element for connecting to the processing circuit can be offered.

According to an embodiment of the present invention, the contact element located on the surface of the adhesive layer may be designed as a graphite layer. The graphite coating possesses great mechanical flexibility with simultaneous good conductivity so that the sensor element can also be attached to curved or otherwise bent surfaces of the products without compromising the reliability.

After use of the sensor element, i.e., after a theft attempt or also during removal of the product protected with the sensor element, the sensor element that is attached to the product by way of an adhesive layer may be easily be removed.

The sensor layer with the integrated measuring circuit loop and a connecting piece for connecting a cable can be separated in the same manner from the adhesive layer and subsequently can be re-used. To ensure the most possible reliability, the old adhesive layer may be replaced with a new adhesive layer. This new adhesive layer then features a new contact element for short-circuiting the measuring circuit loop.

To use the sensor element, the adhesive layer may be attached to the product that is to be protected by pressing one side of the adhesive layer onto the product. Then the sensor layer of the sensor element may be positioned with the end contacts on the adhesive surface of the adhesive layer such that the end contacts are shorted by the contact element located on the surface of the adhesive layer. It is understood that this process can be done in reverse, as well. After activation of the processing circuit, every interruption of the measuring circuit loop that is shorted in this way leads to an alarm condition.

The measuring circuit loop integrated in the sensor layer includes, as previously mentioned, film conductors, for example, and is mainly insulated. According to an embodiment of the present invention, the end contacts located in the interruption area of the of the measuring circuit loop contain no insulation on their side facing the contact element during operation.

The reliability of the electrically conductive connection between the end contacts of the measuring circuit loops and additionally, the contact element can be increased even further in that the end contacts may contain a slight increase, for example, in the form of a relay-circuit contact. This end contact design is also applicable and practical with another type of designed contact element, for example, with a contact element including metal foil.

According to an embodiment of the present invention, a sensor element may include a portion of the measuring circuit loop that is designed as a resonator. Therefore, the sensor element can contribute also in another way to theft protection of the product, apart from monitoring of the measuring circuit loop.

If unnoticed removal of the product is successful during an attempt to steal the product, a resonator, which is still attached to the product and can be formed by a part of the measuring circuit loop that is integrated in the sensor layer of the sensor element, can be detected in a traditional magnetic field arrangement. Such systems are widespread and located often at entrances and exits of department stores.

Moreover, according to an embodiment of the present invention, a monitoring device may be designed so that the measuring circuit loop features a break and the sensor layer can be attached to the product by way of an adhesive layer in such a way that a contact element located on the surface of the adhesive layer short-circuits the break.

According to yet another embodiment of the present invention, a second sensor element may be included, with which the processing circuit can be mounted to a shelf or the like in a secured manner. The second sensor element functions in substantially the same manner as the sensor element that is attached to the product itself.

The monitoring device according to an embodiment of the present invention provides a sensor layer that includes a second sensor element that can be attached to a shelf by way of an adhesive layer, in particular by way of a double-sided adhesive strip.

To provide attachment of the second sensor element to the shelf, the adhesive layer may feature a contact element that short-circuits a break between the end contacts of a measuring circuit loop that is integrated in the sensor layer of the second sensor element.

For monitoring a condition of the measuring circuit loop located in the second sensor element, a cable may provided whereby the second sensor element can be connected with the processing circuit.

The second sensor element may be connected with the processing circuit in a non-detachable manner or at least is, compared to the connection produced with the adhesive layer between the sensor layer and the shelf, more difficult to remove. The non-detachable connection can be formed for example, as a glued bonding. In this case the measuring circuit of the second sensor element may be separated as soon as the processing circuit is seized and moved relative to the adhesive layer located on the shelf including the contact element located on it. This activates an alarm.

In particular lifting the processing circuit off the shelf and lateral shifting as well as a twisting of the processing circuit about an axis of rotation roughly vertical to the shelf surface may lead to activation of an alarm.

Removal of the second sensor element between the processing circuit and the shelf, which can occur, for example, through grabbing/pulling of the connection cable for the processing circuit, likewise may cause the alarm to be triggered.

Theft attempts which may include sliding a thin object underneath the adhesive layer like for example, a knife or a razor blade, may be reliably detected by the monitoring device according to an embodiment of the present invention.

Commonly lifting and/or removal of the unit including the processing circuit and the second sensor element from the adhesive layer does not lead to the destruction of the second sensor element. Therefore, reuse of the second sensor element is possible.

An embodiment of the present invention includes a second sensor element that can be integrated in a processing circuit so that a sensor layer of the second sensor element and a connection cable for the processing circuit may be eliminated. The end contacts of the measuring circuit loop may therefore be formed as spring metal strips that are fastened on the product lower housing wall or guided through it and are connected with processing electronics of the processing circuit.

According to an embodiment of the present invention, the sensor element may be equipped with a second measuring circuit loop, which contains a break and which may be switched electronically in series to the first measuring circuit loop, and the sensor layer may be attached with a second adhesive layer to a fastening element in such a manner that a contact element located on the second adhesive layer shorts the break of the second measuring circuit loop.

The functionality of the second measuring circuit loop may be substantially the same as the functionality of the first measuring circuit loop, i.e., a lifting of the contact element of the second adhesive layer may cause an interruption of the second measuring circuit loop and with it triggers an alarm. Through this the sensitivity level of the sensor element may be increased.

The series connection of the first and the second measuring circuit loop may be beneficial because this connection can be established to a processing circuit with a traditional cable, i.e., like a sensor element having one measuring circuit loop.

One version of the sensor element according to an embodiment of the present invention includes a sensor layer that may be connected to the second adhesive layer.

The sensor element that may be attached by way of two adhesive layers may be used for securing works of art, especially for securing paintings and/or sculptures or the like. It is useful if both adhesive layers are formed of double-sided adhesive strips. Good adhesive characteristics are achieved for example, with a double-sided adhesive strip Power-Strip™, which is sold by the company Tesa.

The second measuring circuit loop, like the first measuring circuit loop, may be integrated in the sensor layer and can exhibit, for example, the same shape.

It is possible to glue the sensor element with the second adhesive layer to the processing circuit and glue it to a shelf or a wall by way of the first adhesive layer. Instead of the cable used to connect the sensor element with the processing circuit, the sensor layer may be integrated at least partially into the processing circuit.

Further scope of applicability of the present invention will become apparent from the detailed description given hereinafter. However, it should be understood that the detailed description and specific examples, while indicating embodiments of the present invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF EXEMPLARY EMBODIMENTS

Figure 3:
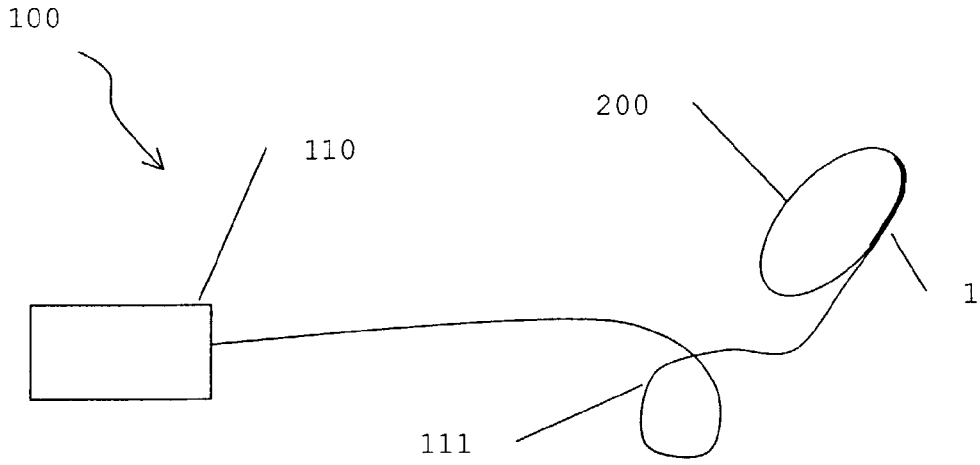
FIG. 3 illustrates a monitoring device according to an embodiment of the present invention.

A monitoring device 100 illustrated in FIG. 3 serves the purpose of protecting a product 200 that is displayed for sale against theft. The product 200 may be displayed in a shelf of a display room (not shown) and the customer can remove it from the shelf for closer observation.

The product 200 may be a small inexpensive electrical appliance, whose modern housing shape pursuant to FIG. 3 substantially corresponds to an ellipsoid.

Figure 2:
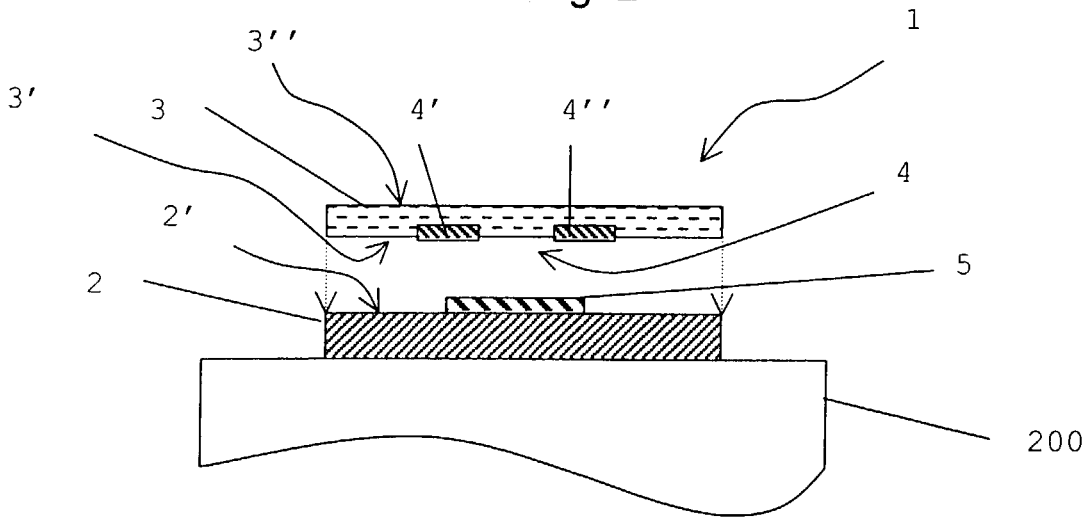
FIG. 2 illustrates an enlarged view of a cross-section of the sensor element illustrated in FIG. 1 together with an adhesive layer, viewed along the line X—X from FIG. 1 and in the direction of the arrow.

Monitoring of the product 200 takes place through a sensor element 1, which is attached to the ellipsoid-shaped housing of the product 200 with an adhesive layer 2, and which is illustrated in an enlarged image in FIG. 2 and is depicted in a cross-sectional view. For simplicity reasons of the depiction, the housing surface of the product 200 is illustrated in FIG. 2 having a straight shape.

So that it will adhere well to the surface of the product housing, the sensor element 1 has a flexible design. This way it can be connected with the product 200 in a particularly firm and secure manner since substantially the entire surface of the adhesive layer 2 (FIG. 2) facing the product housing contributes to the adhesion of the sensor element 1 to the surface of the product housing.

The sensor element 1 also permits fastening on the rear of the product 200 so that an appealing presentation of the product 200 is possible. In particular, a view of the front of the product 200 is not obstructed.

Flexibility of the sensor element 1 permits attachment of the sensor element 1 on nearly any random parts of the product surface so that even with products of different housing shapes, the simple and safe attachment of the sensor element 1 is substantially guaranteed.

In order to evaluate signals generated by the sensor element 1, a processing circuit 110 is provided in the monitoring device 100, as is illustrated in FIG. 3. The processing circuit 110 is connected with the sensor element 1 by way of a cable 111.

Figure 1:
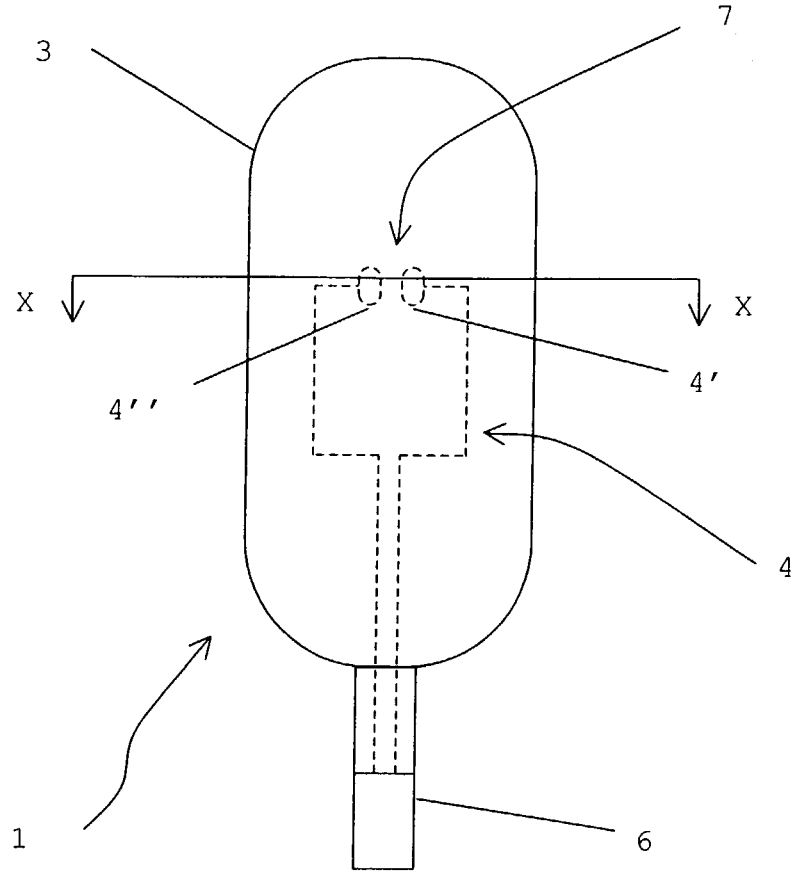
FIG. 1 illustrates a sensor element according to an embodiment of the present invention.

Connection of the cable 111 with the sensor element 1 may be achieved through a connecting element 6, which can be seen in FIG. 1. A surface-mounted light-emitting diode (surface mounted device, SME) (not shown), which is arranged on the sensor element in the area of the connecting element 6, is part of a signal circuit of the sensor element 1 and serves the purpose of indicating at least two operating modes.

In a first operating state, the idle mode, the light-emitting diode is lit without interruption; in a second operating state, the alarm mode, the light-emitting diode flashes at a specified frequency.

With reference to FIGS. 1 and 2, the following provides a detailed description of the sensor element 1 according to an exemplary embodiment of the present invention.

The sensor element 1 depicted in FIG. 1 has a layer design, as is illustrated in FIG. 2. The cross-section illustrated in FIG. 2 is taken along line X—X in FIG. 1.

The dimensions of the individual components of the sensor element 1 are in part not reflected true to scale for clarity reasons.

The sensor element 1 may include a sensor layer 3, to which the adhesive layer 2 located substantially congruent beneath the sensor layer 3 is allocated.

The adhesive layer 2 includes double-sided adhesive strip, which is available commercially, for example, under the tradename Power-Strip™ from Tesa Company. However, other double-sided adhesive strips may also be used as desired and dictated by manufacturing constraints and costs.

On the surface 2', which faces the sensor layer 3 of the adhesive layer 2, a contact element 5 is arranged, which is electrically conductive. The contact element 5 may be a graphite layer.

On the surface 3', which faces the contact element 5 of the sensor layer 3, two end contacts 4', 4" are arranged, which as illustrated in FIG. 1, are both part of a measuring circuit loop 4. The end contacts 4', 4" are arranged at a distance from each other so that the measuring circuit loop 4 is not short-circuited, but contains a break 7.

The measuring circuit loop 4 with the end contacts 4', 4" is integrated into the sensor layer 3 and includes very flexible film conductors, which pursuant to FIG. 1 extend all the way to the connecting element 6. The sensor layer 3 includes an insulating plastic film and encloses the film conductors of the measuring circuit loop 4 all the way to the sides of the end contacts 4', 4" facing the contact element 5.

In order to make the sensor element 1 operational, the sensor layer 3 may be pressed with the surface 3' in the direction of the dotted arrows from FIG. 2 onto the surface 2' of the adhesive layer 2. The two end contacts 4', 4" are thus connected with each other in an electrically conductive manner through contact with the contact element 5, thereby closing the measuring circuit loop 4.

While pressing the sensor layer 3 onto the adhesive layer 2, attention must be paid that the end contacts 4', 4" rest on the contact element 5 as accurately as possible in order to ensure secure and permanent contact.

After pressing, the sensor layer 3 adheres to the surface 2' of the adhesive layer 2 with the surface 3', and the end contacts 4', 4" remain in contact with the contact element 5 so that the measuring circuit loop 4 continues to remain closed.

The arrangement of the end contacts 4', 4" and the contact element 5 can be interpreted as a series configuration of two switches, wherein the first switch is formed by the end contact 4' and the contact element 5, and the second switch by the end contact 4" and the contact element 5.

The ohmic resistance of the measuring circuit loop 4 changes as a function of the position that the end contacts 4', 4" and the contact element 5 have to each other. The measuring circuit loop 4 is, as already mentioned, short-circuited when the sensor layer 3 rests at least in the area of the end contacts 4', 4" against the adhesive layer 2 such that both switches that are arranged in series and are formed by the end contacts 4', 4" and the contact element 5 are closed. This configuration marks the idle state.

When lifting the sensor layer 3 upward off the adhesive layer 2, the measuring circuit loop 4 is interrupted as soon as at least one of the two switches opens up. This represents the alarm state in which e.g., an attempt for theft is indicated visually and/or acoustically.

An interruption of the measuring circuit loop 4 can also occur through a purely lateral shift, i.e., parallel to the surface 2' of the adhesive layer 2, of the end contacts 4', 4" and the contact element 5 relative to each other.

Particularly beneficial in the design of the sensor element 1 pursuant to an embodiment of the present invention is the feature that the attempt to pull the adhesive layer 2 laterally out between the product 200 and the sensor layer 3 already leads to such a shift of the end contacts 4', 4" and the contact element 5 relative to each other that the measuring circuit loop 4 is interrupted.

In this case, it is not as important, whether while pulling out the adhesive layer 2 simultaneously a normal force, acting vertically to the surface 2' and thus also vertically to the pulling direction, is applied in the area of the end contacts 4', 4" in order to press them firmly against the contact element 5 so as to apparently prevent an alarm, i.e., in this case, the attempt of theft is reliably detected, as well.

In the alarm state, the end contacts 4', 4" are isolated against each other. The break 7 in the measuring circuit loop 4 caused by the end contacts 4', 4" is active. Thus, in the ideal case, the ohmic resistance of the measuring circuit loop 4 is infinitely great.

A particularly high sensitivity level of the sensor element 1 results from the fact that the alarm state already occurs when a single end contact 4', 4" is separated from the opposite contact element 5, i.e., when one of the two switches opens up.

In the idle state, the ohmic resistance between the end contacts 4', 4" is very small. The break 7 is bridged with the contact element 5. The ohmic resistance is composed of the specific resistance of the film conductor and the contact element 5 as well as from the transition resistance values of the switches.

Since the connection that is established by the adhesive layer 2 can be detached, a sensor element 1 that has been used can be detached from the product 200 and attached to another product. The sensor element 1 is designed such that it tolerates detachment from the product 200 without incurring damage.

The reliability of the sensor element 1 can be raised by using a new adhesive layer 2 with fresh adhesive surfaces after use. For this, the sensor layer 3 is detached from the adhesive layer 2. The sensor layer 3 with the measuring circuit loop 4 can then be re-used.

In general, the sensor element 1 can be used multiple times and is therefore very economical. In particular, the measuring circuit loop 4 with the film conductors is not damaged when detaching the sensor element 1. Worsening of the contact properties due to wear caused by contamination of the contact element 5 may be prevented because a new adhesive layer 2 with a new contact element 5 arranged thereupon can be used at any time.

The sensor element 1 that is connected with the product 200 in the above-explained manner is ready for use without further provisions and transitions from its idle state into the alarm state as soon as force is applied onto the adhesive layer 2 and/or the sensor layer 3 in such a way that at least one of the switches is opened up.

The processing circuit 110 permanently detects the ohmic resistance of the measuring circuit loop 4 or a test current flowing through it and recognizes the alarm state as soon as the measuring circuit loop 4 is interrupted for the first time. Thereupon the alarm situation is passed on to e.g., a central monitoring station, and the light-emitting diode is changed to a flashing state.

Triggering of the light-emitting diode hereby occurs through a separate control line, which runs from the processing circuit 110 through the cable 111 to the signal circuit. Additionally, an acoustic alarm signal is emitted.

The processing circuit 110 is designed such that the temporary occurrence of an alarm state, i.e., a brief interruption of the measuring circuit loop 4, suffices for triggering an alarm. A memory element in the processing circuit 110 may store the alarm state until the monitoring device 100 is reset.

The signal circuit may be connected with the measuring circuit loop 4 so that for example, an existing ground lead can be used both for the signal circuit and for the measuring circuit loop 4. This reduces the number of lines or leads required in the cable 111 and the complexity of the switch configuration.

The flashing state of the light-emitting diode may be maintained until the monitoring device 100 is reset. Therefore, it is possible to register or locate theft attempts through simple visual controls even without direct access to the processing circuit 110.

The cable 111 from FIG. 3 may be detachably connected with the connecting element 6 (FIG. 1). The connecting element 6 therefore contains a plug (not shown) or another manner for establishing a detachable connection. The cable 111 may be equipped with a suitable counter-piece such as e.g., a socket.

As an alternative to the detachable connection between the connecting element 6 and the cable 111, a fixed connection, for example, a soldered connection, is also feasible. This is especially useful when the unit including the sensor element 1 and cable 111, which is also described as a sensor cable, is supposed to be used e.g., as a replacement part for an existing monitoring device 100.

Particularly beneficial is also a design where at least a portion of the measuring circuit loop 4 is a resonator, which affects a distortion in the surrounding magnetic field that can be detected with measuring devices. The specific design of the measuring circuit loop 4 as a resonator does not influence the suitability of the measuring circuit loop 4 for measuring ohmic resistance and/or for monitoring the test current through the measuring circuit loop 4.

The resonator is capable of triggering an alarm when passing conventional security barriers, however, which are based on the detection of magnetic fields or of field distortions that are generated by resonators located in merchandise labels. Thus, double protection against theft of the displayed merchandise is possible.

Figure 4:
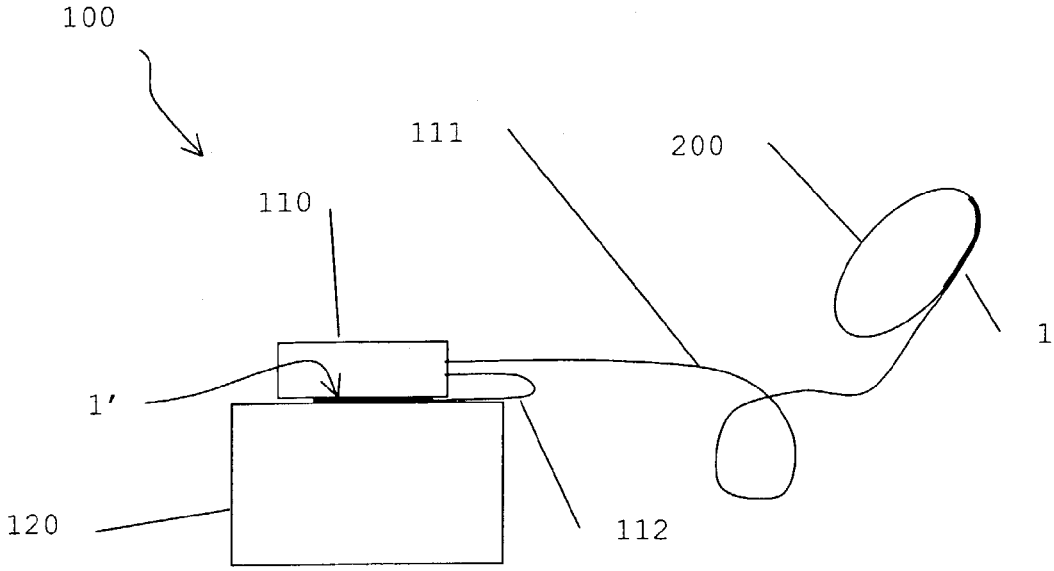
FIG. 4 illustrates a monitoring device according to another embodiment of the present invention.

An embodiment of the present invented including a monitoring device 100 is depicted in FIG. 4. Substantially equivalent to the monitoring device 100 from FIG. 3, in the second design from FIG. 4, a merchandise 200 is secured with a sensor element 3, which is connected with the merchandise 200 through an adhesive layer 2. A sensor element 1 is connected with the processing circuit 110 by way of a first cable 111.

The processing circuit 110 in FIG. 4 may be attached to a shelf 120 and secured with a second sensor element 1' so that a lifting and/or twisting and/or shifting of the processing circuit 110 relative to the shelf 120 triggers an alarm.

The second sensor element 1' functions in substantially the manner and has substantially the same design (see FIG. 2) as the sensor element 1 that is arranged directly on the merchandise 200 and is equally fastened to the shelf 120 in a detachable manner by way of an adhesive layer 2 (FIG. 2). The second sensor element 1' and the processing circuit 110 may be connected with each other in a non-detachable manner, which can be accomplished for example, by way of gluing. In particular the surface 3" of the second sensor element 1' can be glued to the processing circuit 110.

The adhesive layer 2 of the second sensor element 1' may include a double-sided adhesive strip, which is commercially available for example, under the tradename PowerStrip™ from Tesa company. However, other double-sides adhesive strips may also be used as desired.

Connection of the second sensor element 1' to the processing circuit 110 may be established through a second cable 112.

The second sensor element 1' may be integrated into the processing circuit 110 or in the housing thereof. Therefore, a direct connection between the second sensor element 1' and an electronic evaluation device of the processing circuit 110 may be established so that the cable 112 can be eliminated.

Such integration can—as already mentioned—be realized by adhesive bonding between the surface 3" of the second sensor element 1' and the processing circuit 110 that is non-detachable or very difficult to detach. A second possibility for establishing the integration includes designing the measuring circuit loop as an injection-molded circuit carrier, which can be produced in the same production step as the housing of the processing circuit 110.

As already mentioned, a lifting of the processing circuit 110 off the shelf 120 and a lateral shifting as well as a twisting of the processing circuit 110 about an axis of rotation that is roughly vertical to the shelf surface causes an alarm to be triggered in the presented monitoring device 100.

Beyond that an alarm may also be triggered from the attempt to lift and/or remove the sensor element 1 located on the merchandise 200 from the merchandise 200.

Figure 5:
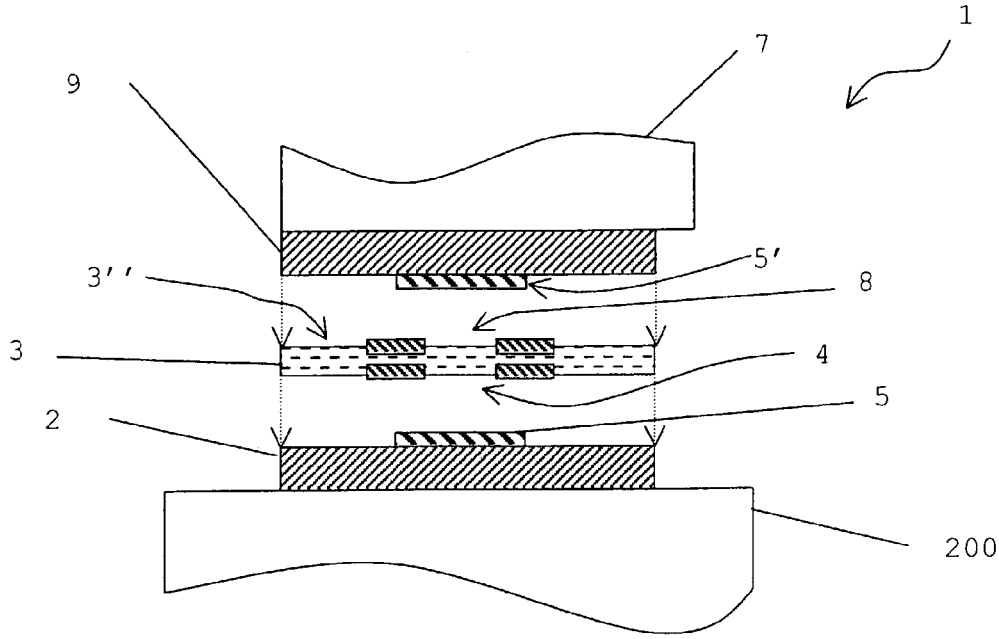
FIG. 5 illustrates an enlarged view of a cross-section of a sensor element having a plurality of adhesive layers according to an embodiment of the present invention.

FIG. 5 illustrates another embodiment of a sensor element 1 according to the present invention. As can be seen in FIG. 5, the sensor layer 3 is equipped with a second measuring circuit loop 8, which contains a break and is connected electrically in series to the measuring circuit loop 4. The sensor layer 3 can be attached with a second adhesive layer 9 to a fastening element 7 such that a second contact element 5', which is arranged on the second adhesive layer 9, short-circuits the break of the second measuring circuit loop 8 in the manner that was already described in connection with FIG. 2. The contact element 5' may be a graphite layer.

Through series connection of the measuring circuit loops 4, 8 the break of one of the two measuring circuit loops 4, 8 suffices for triggering an alarm. The sensor element 1 thus exhibits a particularly high level of sensitivity.

A series connection of the first and the second measuring circuit loop 4, 8 may also be beneficial because the sensor element 1 can be connected to an processing circuit with a conventional cable 112, i.e., exactly like a sensor element with only one measuring circuit loop 4.

It may also beneficial to connect the sensor layer 3 with the first adhesive layer 2 and/or the second adhesive layer 9 during production of the sensor element 1.

The sensor element 1 from FIG. 5 may be suitable for securing works of art, especially for securing paintings and/or sculptures or the like. Both adhesive layers 2, 9 are preferably made of double-sided adhesive strips. Very good adhesive properties can be achieved for example, with a double-sided adhesive strip as the one marketed by Tesa company under the tradename Power-Strip™, with which the sensor layer 3 can be connected detachably even with paper without leaving residue on the paper or destroying it when removing the adhesive layer.

The second measuring circuit loop 8, like the first measuring circuit loop 4, is integrated into the sensor layer 3 and can take on, for example, the same shape or also a different shape.

It is also possible to glue the sensor element 1 with the second adhesive layer 9 to the processing circuit 110 (FIG. 4) and glue it by way of the first adhesive layer 2 to a merchandise shelf 120 (FIG. 4) or a wall. Accordingly, the sensor layer 3 may be integrated at least partially into the processing circuit 110 instead of using the cable 112 for the purpose of connecting the sensor element 1 with the processing circuit 110.

Figure 6A:
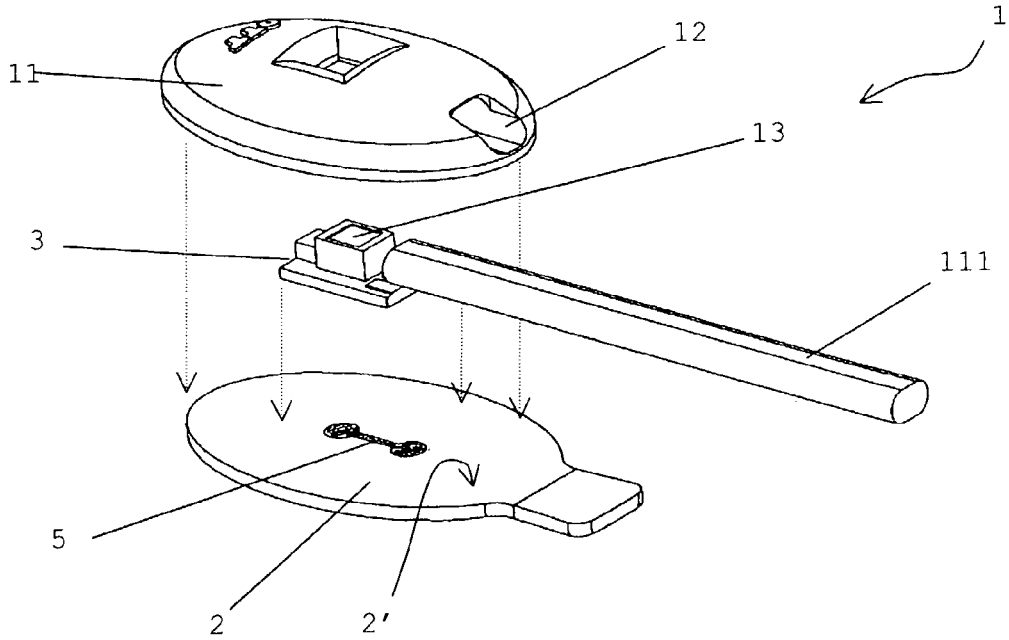
FIG. 6*a* illustrates a perspective view of a sensor element having an adhesive layer and a cover according to an embodiment of the present invention.

FIG. 6*a* illustrates a sensor element 1 where the sensor layer 3 is generally rigid, for example, includes the use of a rigid board. The measuring circuit loop 4 (not shown) is may be located directly on the bottom of the board, on which—as shown in FIG. 6*b*—also the end contacts 4', 4" are arranged.

Figure 6B:
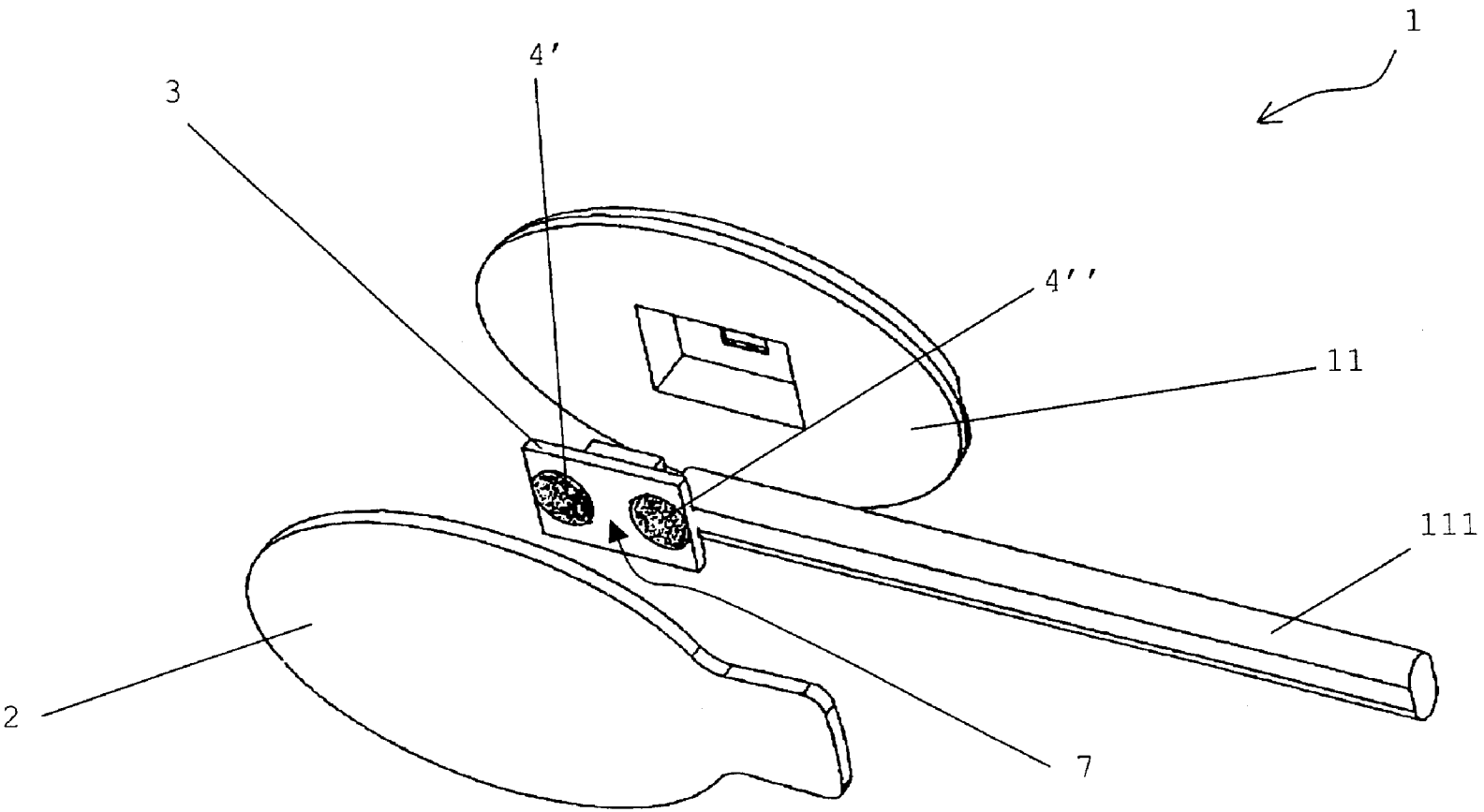
FIG. 6*b* illustrates the sensor element of FIG. 6*a* from a different perspective.

On the surface 2' of the adhesive layer 2 (FIG. 6*a*), a contact element 5, whose shape has been adapted to the end contacts 4', 4" (FIG. 6*b*), may be arranged, which upon connection of the sensor layer 3 with the adhesive layer 2 pursuant to the dotted arrows running vertically in FIG. 6*a* short-circuits the measuring circuit loop 4 (not shown) by bridging the break depicted in FIG. 6*b* between the end contacts 4', 4" in an electrically conductive manner. The contact element 5 may also include a graphite layer that has been applied to the surface 2' of the adhesive layer 2.

A cable 111 may be provided for the purpose of connecting the sensor element 1 with the processing circuit 110 (FIG. 3).

The sensor element 1 is furthermore assigned a cover 11, which can also be connected with the adhesive layer 2 and protects the sensor layer 3. A through-hole 12 (FIG. 6*a*) integrated in the cover 11 may also be provided, through which the cable 111 can be guided.

The board may be glued onto the cover 11.

The cover 11 may include a window roughly in a center thereof, which surrounds a light-emitting diode 13 that is attached to the board of the sensor layer 3. The light-emitting diode 13 indicates operating modes of the sensor element 1 or of the processing circuit 110. The light-emitting diode 13 may be a surface-mounted (SMD) component.

The adhesive layer 2 may be designed as a double-sided adhesive strip, which due to its elasticity, can also be glued onto rounded sections of the merchandise 200. The dimensions of the rigid board can be selected so small that even with attachment of the sensor element 1 in areas of very small bending radius on the merchandise housing the measuring circuit loop 4 (not shown) is reliably short-circuited by the contact element 5 and an alarm may be triggered when the measuring circuit loop 4 is separated.

The flexibility of the sensor element 1 may be increased by the fact that the cover 11 includes elastic material, for example, made of a rubbery plastic or latex, or the like.

The alarm is triggered in this design of the sensor element 1 in substantially the same manner as in the variations described already above.

The cover 11 of the sensor element 1 may also have a rigid design.

Embodiments of the present invention relate to a sensor element 1 for a monitoring device 100 designed to protect displayed merchandise 200 against theft. The sensor element 1 may be flexible and contain a sensor layer 1 with a measuring circuit loop 4 integrated therein.

When force is applied such as e.g., during attempted theft, a contact element 5 that is arranged on the adhesive surface 2 and short-circuits a break in the measuring circuit loop 4 in the idle state can be separated from the measuring circuit loop 4, triggering an alarm.

The sensor element 1 may be detachably connected with the merchandise 200 that is to be monitored and is re-usable.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sensor element comprising:

a sensor layer having a measuring circuit loop, the measuring circuit loop having a break, the sensor layer being fastenable to a device by way of an adhesive layer having a contact element positioned on a surface thereof, the contact element for short-circuiting the break of the measuring circuit loop, wherein the sensor element is one of flexible and elastic;

wherein the sensor layer includes a second measuring circuit loop, the second measuring circuit loop having a break and being connected electrically in series to the measuring circuit loop, the sensor layer being attachable to a fastening element via a second adhesive layer, and the second adhesive layer includes another contact element for short-circuiting the break of the second measuring circuit loop.

2. The sensor element according to claim 1, wherein the sensor layer is connected with the second adhesive layer.

3. The sensor element according to claim 1, wherein the sensor element is rigid.

4. The sensor element according to claim 1, wherein the adhesive layers are double-sided adhesive strips.

5. A monitoring device for protecting displayed merchandise against theft, the monitoring device comprising:

a processing circuit;

a cable for connecting a sensor element with the processing circuit;

wherein the sensor element includes a sensor layer having a measuring circuit loop, the measuring circuit loop including a break, the sensor layer being attachable to the merchandise by way of an adhesive layer, the adhesive layer having a contact element located on a surface thereof, the contact element for short-circuiting the break in the measuring circuit loop, and wherein the sensor element is one of flexible and elastic; and a second sensor element, the second sensor element at least for attaching the processing circuit to a member.

6. The monitoring device according to claim 5, further comprising a cable for connecting the second sensor element with the processing circuit.

7. The monitoring device according to claim 5, wherein a sensor layer of the second sensor element is attachable to the member by way of another adhesive layer.

8. The monitoring device according to claim 5, wherein the second sensor element is attachable to the processing circuit in a non-detaching manner.

9. The monitoring device according to claim 5, wherein the second sensor element is integrated with the processing circuit.

10. A method comprising securing works of art from theft by way of the sensor in accordance with claim 1.

* * * * *